US008919061B2

(12) United States Patent
Kortuem et al.

(10) Patent No.: US 8,919,061 B2
(45) Date of Patent: Dec. 30, 2014

(54) MOISTURE DRAINAGE SPACER PANEL FOR BUILDING WALLS

(75) Inventors: Matt Kortuem, Blandon, PA (US); David B. Rosten, Isanti, MN (US); Palle Rye, Shillington, PA (US); David J. Bonanni, Fleetwood, PA (US); Richard Pirino, Wyomissing, PA (US)

(73) Assignee: Brentwood Industries, Inc., Reading, PA (US)

( * ) Notice: Subject to any disclaimer, the term of this patent is extended or adjusted under 35 U.S.C. 154(b) by 751 days.

(21) Appl. No.: 12/362,376

(22) Filed: Jan. 29, 2009

(65) Prior Publication Data

US 2009/0193738 A1 Aug. 6, 2009

Related U.S. Application Data

(60) Provisional application No. 61/026,506, filed on Feb. 6, 2008.

(51) Int. Cl.

| | |
|---|---|
| ***E04C 2/32*** | (2006.01) |
| ***E04B 1/70*** | (2006.01) |
| ***E02D 31/02*** | (2006.01) |
| ***E04B 2/70*** | (2006.01) |

(52) U.S. Cl.

CPC ..... *E04B 1/7069* (2013.01); *E04C 2/326* (2013.01); *E02D 31/02* (2013.01); *E04B 2/707* (2013.01)

USPC ..... 52/302.3

(58) Field of Classification Search

CPC ..... E02D 31/02; E04B 1/70; E04B 11/005; E04C 2/326; E04C 2002/3427

USPC ..... 52/302.1, 58, 60, 61, 302.6, 302.3, 408, 52/413, 506.05

See application file for complete search history.

(56) References Cited

U.S. PATENT DOCUMENTS

| | | | | |
|---|---|---|---|---|
| 2,264,961 | A * | 12/1941 | Ward | 52/302.3 |
| 2,277,791 | A * | 3/1942 | Small | 52/404.1 |
| 4,574,541 | A | 3/1986 | Raidt | 52/169.5 |
| 5,052,161 | A * | 10/1991 | Whitacre | 52/385 |
| 5,489,462 | A * | 2/1996 | Sieber | 428/174 |
| 5,688,073 | A * | 11/1997 | Brodeur et al. | 405/45 |
| 5,692,348 | A * | 12/1997 | Ambrosino | 52/169.5 |
| 5,860,259 | A | 1/1999 | Laska | 52/302.3 |
| 6,298,620 | B1 | 10/2001 | Hatzinikolas | 52/302.1 |
| 6,523,309 | B1 * | 2/2003 | Finlay et al. | 52/169.5 |
| 6,594,965 | B2 | 7/2003 | Coulton | 52/302.1 |
| 6,691,472 | B2 * | 2/2004 | Hubert | 52/169.5 |
| 6,761,006 | B2 | 7/2004 | Lubker | 52/302.1 |
| 6,786,013 | B2 | 9/2004 | Coulton | 52/198 |
| 6,869,901 | B2 | 3/2005 | Lubker | 442/208 |

(Continued)

*Primary Examiner* — Christine T Cajilig

(74) *Attorney, Agent, or Firm* — Miller Law Group, PLLC

(57) ABSTRACT

A spacer panel is incorporated into building walls to drain accumulated moisture from the wall structure. The spacer panel is formed with spacer members that project on opposing sides of a central planar web member. Each spacer member is formed independently and has a planar portion extending around the spacer member to provide a location for the insertion of apertures to allow moisture to pass from one side of the panel to the other. Each spacer member includes a planar surface that facilitates an application of adhesive for attachment of a barrier member thereto. The spacer members can be oriented in a herringbone pattern alternating on opposing sides of the central web member. The spacer members can be formed as a circular projection extending on one side of the central web with a truncated conical member projecting to the opposing side of the central web from the circular projection.

9 Claims, 7 Drawing Sheets

(56) References Cited

U.S. PATENT DOCUMENTS

| | | | | |
|---|---|---|---|---|
| 6,990,775 | B2 * | 1/2006 | Koester | 52/302.1 |
| 7,698,858 | B2 | 4/2010 | Schroer | 52/169.5 |
| D624,322 | S | 9/2010 | Schroer | D5/60 |
| 2002/0139068 | A1 * | 10/2002 | Janesky | 52/169.5 |
| 2003/0115809 | A1 * | 6/2003 | Pontarolo | 52/80.1 |
| 2004/0226238 | A1 * | 11/2004 | Haapiainen | 52/302.1 |
| 2007/0283639 | A1 * | 12/2007 | Kortuem et al. | 52/198 |
| 2008/0086958 | A1 * | 4/2008 | Schroer et al. | 52/169.14 |

* cited by examiner

Fig. 7
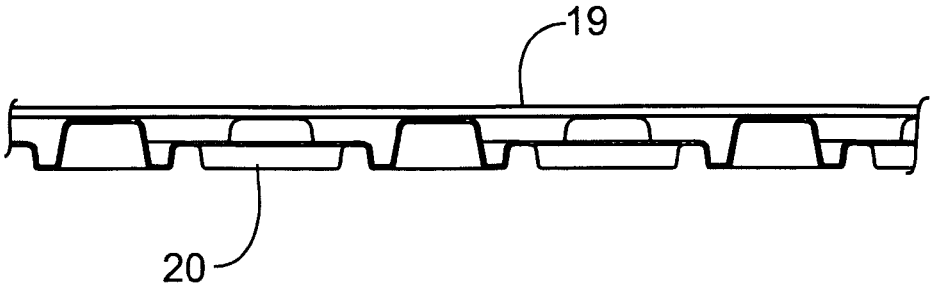
Fig. 8
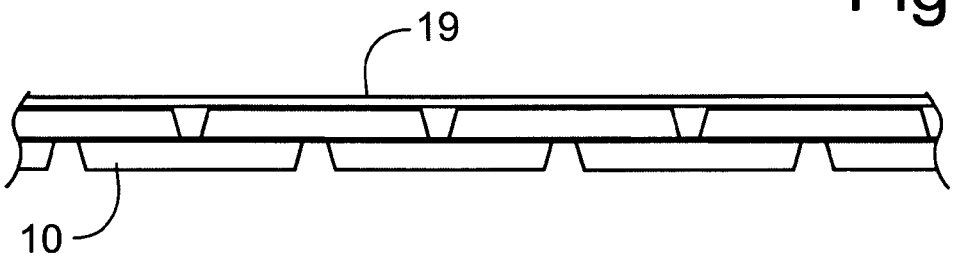
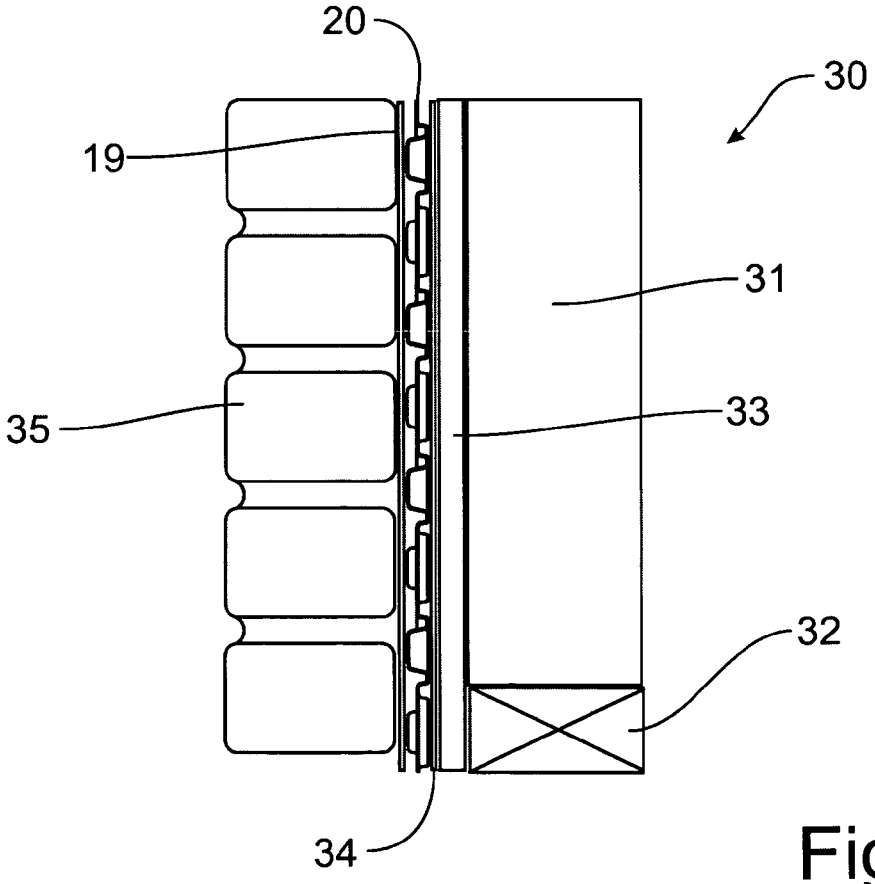
Fig. 9

MOISTURE DRAINAGE SPACER PANEL FOR BUILDING WALLS

CROSS-REFERENCE TO RELATED APPLICATIONS

This application claims priority on U.S. Provisional Patent Application Ser. No. 61/026,506, filed Feb. 6, 2008, and entitled "Moisture Drainage Spacer Panel for Building Walls", the content of which is incorporated herein by reference.

FIELD OF THE INVENTION

This invention relates generally to the construction of exterior building walls in a manner to retard deterioration of the wall and the building substructure supporting the wall, and, more particularly, to a plastic film spacer that resists compression while maintaining a drainage path between the exterior building material and the interior building substructure.

BACKGROUND OF THE INVENTION

Building walls are constructed with an interior building substructure that is often formed of vertical wood studs and a sheathing material that can be plywood or oriented strand board (OSB), particularly in a residential dwelling, or other known building structural materials, and an exterior covering which can be masonry construction or siding manufactured from vinyl, aluminum, wood and other known materials. This interior building substructure is typically wrapped with a plastic sheeting, such as Tyvek® barriers produced by Dupont, that provide a barrier to the passage of air and moisture to the building substructure. For masonry exteriors, a wire mesh is attached to the protective barrier, such as by stapling, and the masonry covering is added, incorporating the wire mesh to help secure the exterior masonry covering to the interior building structure.

Typically, there is a difference between the ambient atmospheric temperature and the temperature of the interior of the building. This temperature differential can result in the formation of condensation along the protective barrier. In masonry exteriors, particularly stucco and dryvet coverings, the masonry material can absorb the condensation and cause deterioration of the masonry exterior covering. To provide an air space between the exterior covering material and the interior building substructure, a spacer member can be placed between the interior and exterior substructures. This spacer member is intended to provide a drainage path for moisture; however, when the exterior covering material compresses the spacer member, the drainage path is reduced and becomes less effective. Even masonry coverings can result in the collapse of the spacer member as the attachment of the wire mesh to the building substructure can result in the compression of the spacer member, as can the attachment of siding materials to the building substructure.

Trapping moisture is a particular problem with building walls utilizing a protective barrier material wrapped around the building substructure. Some of these protective barrier materials are designed to permit the passage of moisture through the barrier material in one direction so that moisture can escape the building but cannot enter the building. Such moisture vapor permitted to pass through the protective barrier must be provided with a drainage path to prevent the moisture from being trapped within the building wall structure. Thus, these plastic spacer members need to provide a drainage ability on both sides of the spacer member to prevent the accumulation of moisture within the building wall structure.

One form of a spacer member can be found in U.S. Pat. No. 6,298,620, granted to Michael Hatzinikolas on Oct. 9, 2001, wherein the moisture control panel is formed with a number of spaced bosses on one side of the base member and a plurality of downwardly oriented weep holes to allow the passage of moisture from one side of the base sheet to the other. Such a spacer member only provides an effective drainage path on one side of the base sheet. Furthermore, the weep holes or perforations formed into the base sheet can become filled with masonry material that can be applied to the perforated side of the base sheet. In U.S. Pat. No. 5,860,259, granted to Walter Laska on Jan. 19, 1999, a similar spacer member is provided with a porous drain section and an insulating section; however, an air space or drainage path is only provided on one side of the spacer member.

A corrugated plastic film spacer member is disclosed in U.S. Pat. No. 6,990,775, issued to John Koester on Jan. 31, 2006, in which the grooves or channels are vertically oriented to provide vertical drainage paths for accumulated moisture, and in which perforations allow for the flow of moisture from one side of the spacer member to the other. In the Koester spacer member, a sheet of water resistant material is preferably attached by adhesive to the outer side of the spacer member to keep masonry material from plugging the channels and preventing the passage of moisture along the channels. The corrugated shape of the undulating ridges and channels are not resistant to compression when exterior materials are nailed or stapled to the interior building substructure. Thus, contractors utilizing such a spacer member would need to be careful of crushing the spacer member when applying the exterior covering materials.

The spacer material in U.S. Pat. No. 6,761,006 granted on Jul. 13, 2004, to John Lubker, and other related patents, such as U.S. Pat. No. 6,869,901, granted on Mar. 22, 2005, are directed to a woven type of a drainage wrap material that is capable of being rolled and applied like the protective barrier on the interior building substructure. The Lubker drainage wrap material provides a three dimensional spacer function while the woven nature of the material allows the passage of moisture from one side of the drainage material to the other. This type of drainage wrap material is subject to being plugged with masonry materials as the outer surface of the drainage wrap material is not conducive to mounting a protective barrier to prevent the passage of masonry materials into the drainage material. As a result, the drainage wrap material can become blocked to prevent the flow of accumulated moisture downwardly.

The spacer material disclosed in U.S. Pat. No. 6,594,965, issued on Jul. 22, 2003, to Michael Coulton is manufactured from a woven fiber material formed in a configuration incorporating vertically oriented ridges and channels. Like the aforementioned U.S. Pat. No. 6,990,775, these channels are not resistant to compression when the exterior covering material is affixed to the building substructure. The formation of the spacer member from woven fiber material is particularly subject to being compressed.

The spacer member disclosed by Michael Coulton in his U.S. Pat. No. 6,786,013, granted on Sep. 7, 2004, does include compression resistant spacer elements that project in opposing directions in a continuous integral formation. While this integral formation of the spacer elements is resistant to compression and does provide a drainage path on both opposing sides of the spacer member, the compression resistant capability is reliant on the interconnected, integrally formed spacer elements. Although this spacer member configuration is capable of being rolled for shipping and handling purposes, the structure of the spacer member does not provide for a good location to form perforations into the spacer member to permit the passage of moisture from one side of the spacer member to the other. Although apertures are disclosed on the apices of the spacer elements, such a location does not provide a good communication from one side of the spacer member to the other. Placing perforations or apertures on the sides of the spacer elements will weaken the integrally formed spacer elements and reduce the compression resistance of the spacer member. Furthermore, the placement of apertures on the apices of the spacer elements restricts the ability to attach a barrier member on the spacer member to prevent the intrusion of masonry material within the valleys formed between spacer elements, and without a barrier member masonry material would fill the spacer voids on one side of the spacer member and disrupt drainage of moisture.

Accordingly, it would be desirable to provide a spacer member for use in constructing exterior walls of buildings to provide drainage paths on opposing sides of the spacer member while providing resistance to compression of the spacer member and the ability to attach an optional barrier member on one side of the spacer member and to incorporate perforations that will allow for flow communication from one side of the spacer member to the other without compromising the compression resistance of the spacer member.

SUMMARY OF THE INVENTION

It is an object of this invention to overcome the disadvantages of the prior art by providing a moisture spacer panel for building walls.

It is another object of this invention to provide a spacer panel that is formed with spacer members that maintain a spacing between the exterior covering materials and the interior sheathing.

It is a feature of this invention that the spacer members are formed with a generally planar surface to facilitate the attachment of a barrier member.

It is an advantage of this invention that a barrier member can be securely affixed to the spacer members.

It is another advantage of this invention that the planar surfaces of the spacer members provide a surface for the application of adhesive for the attachment of a barrier member thereto.

It is another feature of this invention that the spacer members are independently formed on the spacer panel.

It is still another feature of this invention that the spacer members are tapered.

It is another advantage of this invention that the resistance to compression for the spacer members is not dependent on the integrity of the adjacent spacer member.

It is still another advantage of this invention that the spacer members are configured to permit the spacer panel to be rolled or stacked to facilitate shipping.

It is still another feature of this invention that the spacer panel is formed with spacer members projecting from opposing sides of a central web member.

It is another feature of this invention that the spacer members can be arranged in a herringbone pattern.

It is yet another feature of this invention that each respective spacer member is formed with a planar portion of the central web member extending around the spacer member.

It is yet another advantage of this invention that the spacer panel is omni-directional to facilitate application of the spacer panel to building walls.

It is a further feature of this invention that the spacer member can be formed as a truncated conical member that has a portion thereof on opposing sides of a central web member.

It is still a further feature of this invention that the spacer member can be formed with a circular portion on one side of the central web member with the circular portion including a truncated conical portion that projects therefrom to the opposing side of the central web member.

It is a further advantage of this invention that the truncated conical portions stack into the circular portions to permit sheets of spacer panels to stack.

It is still a further advantage of this invention that the truncated conical portions of the spacer members provide planar portions for the application of adhesive and the attachment of a barrier member thereto.

It is another feature of this invention that the planar portions of the central web member surrounding each independently formed spacer member can be perforated to provide a passage for moisture from one side of the spacer panel to the other.

It is yet another advantage of this invention that the perforations will not detrimentally affect the ability of the spacer members to resist compression.

It is still another advantage of this invention that the perforations can be formed in regular or irregular patterns.

It is yet another object of this invention to provide a baffle vent for use in manufactured housing, which is durable in construction, inexpensive of manufacture, carefree of maintenance, facile in assemblage, and simple and effective in use.

These and other objects, features and advantages are accomplished according to the instant invention by providing a spacer panel is incorporated into building walls to drain accumulated moisture from the wall structure. The spacer panel is formed with spacer members that project on opposing sides of a central planar web member. Each spacer member is formed independently and has a planar portion extending around the spacer member to provide a location for the insertion of apertures to allow moisture to pass from one side of the panel to the other. Each spacer member includes a planar surface that facilitates an application of adhesive for attachment of a barrier member thereto. The spacer members can be oriented in a herringbone pattern alternating on opposing sides of the central web member. The spacer members can be formed as a circular projection extending on one side of the central web with a truncated conical member projecting to the opposing side of the central web from the circular projection.

BRIEF DESCRIPTION OF THE DRAWINGS

The advantages of this invention will become apparent upon consideration of the following detailed disclosure of the invention, especially when taken in conjunction with the accompanying drawings wherein:

FIG. 7 is a cross-sectional view of the spacer panel similar to that of FIG. 6, but incorporating a barrier member affixed to the spacer members;

FIG. 8 is an end view of the first embodiment of the spacer panel as shown in FIG. 3, but incorporating a barrier member affixed to the spacer members; and FIG. 9 is a schematic cross-sectional view of a representative building wall incorporating the spacer member shown in FIG. 7.

DETAILED DESCRIPTION OF THE PREFERRED EMBODIMENT

Figure 1:
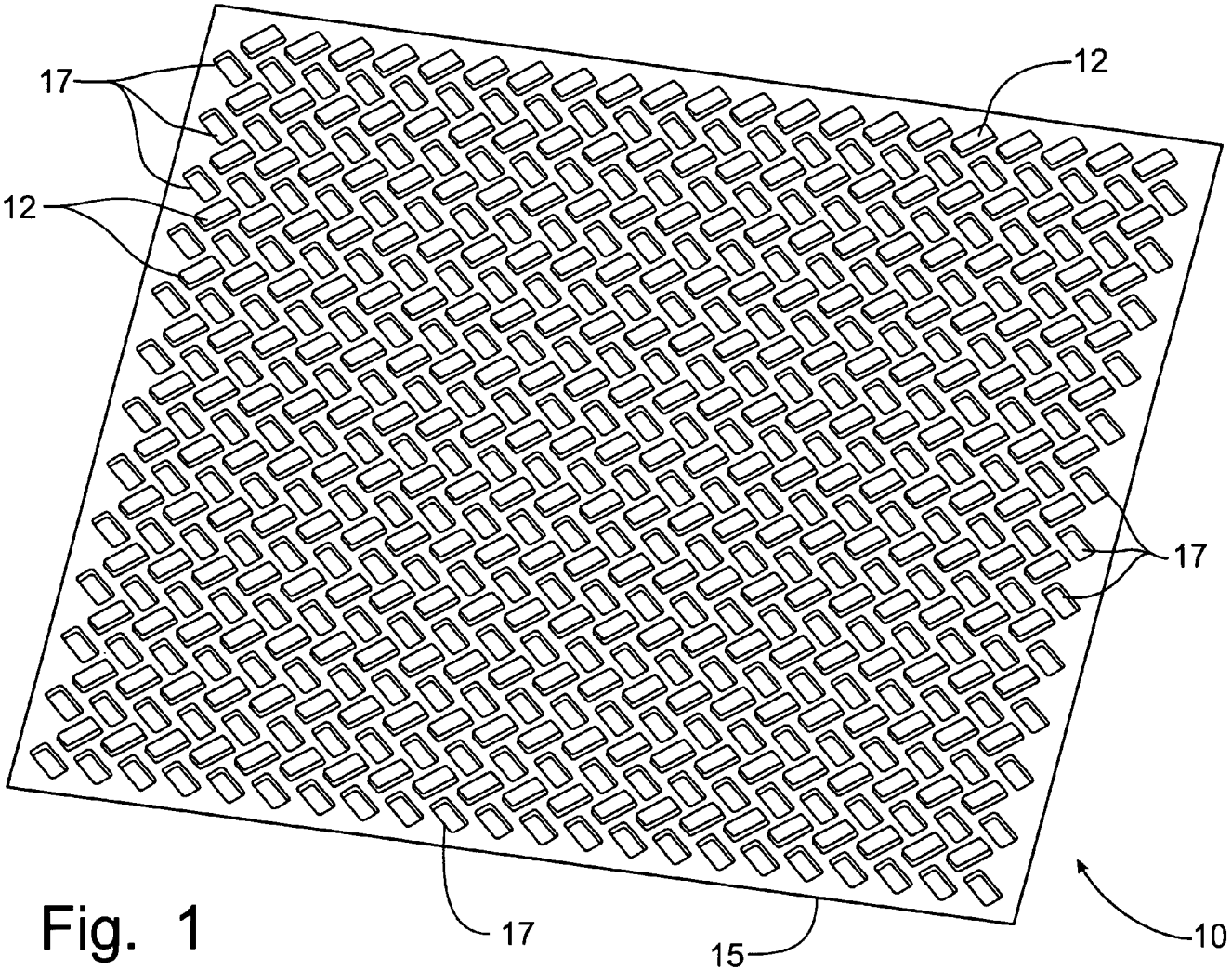
FIG. 1 is a perspective view of a first embodiment of a spacer panel incorporating the principles of the instant invention.
Figure 2:
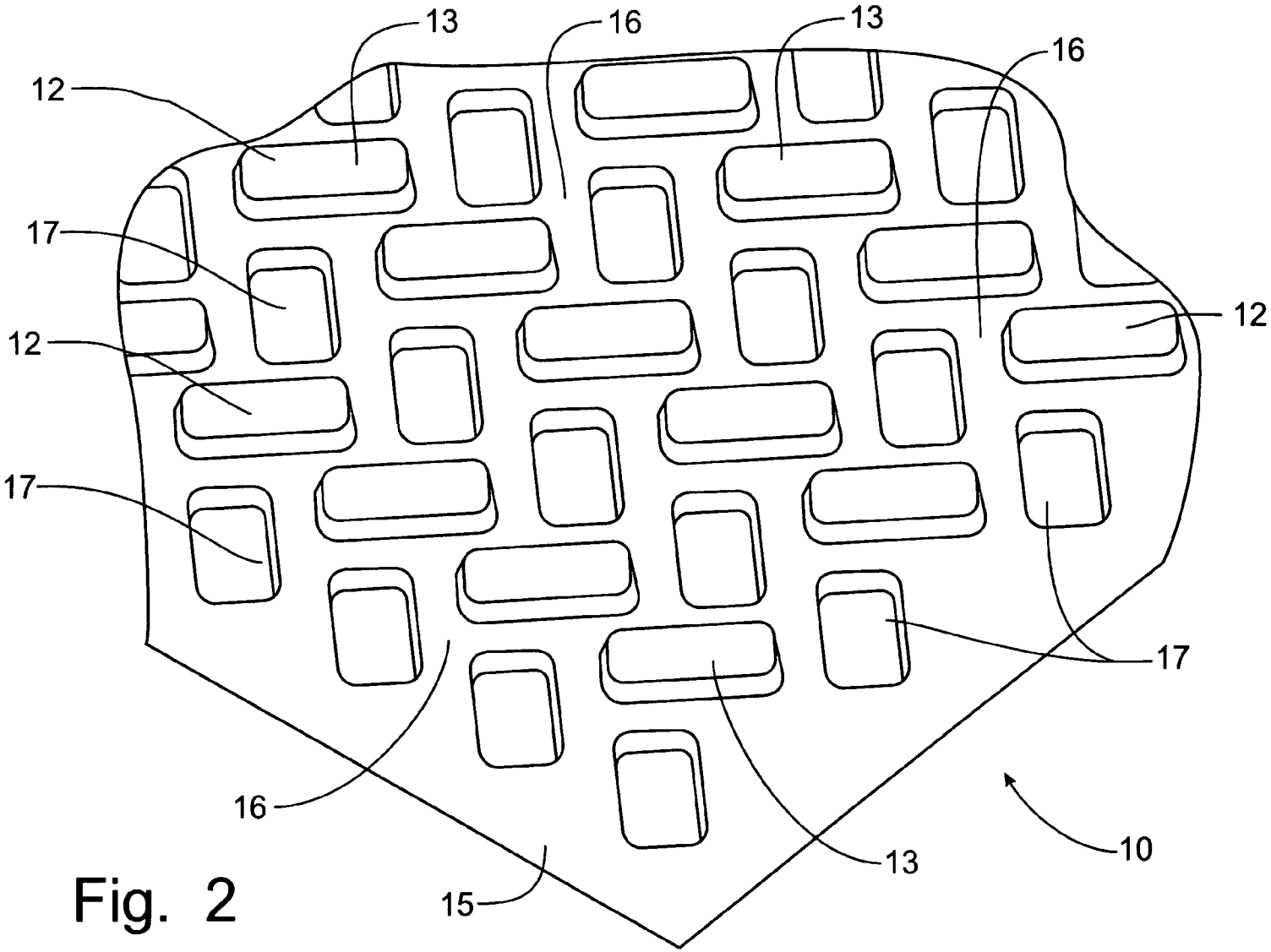
FIG. 2 is an enlarged perspective view of a portion of the spacer panel shown in FIG. 1.
Figure 3:
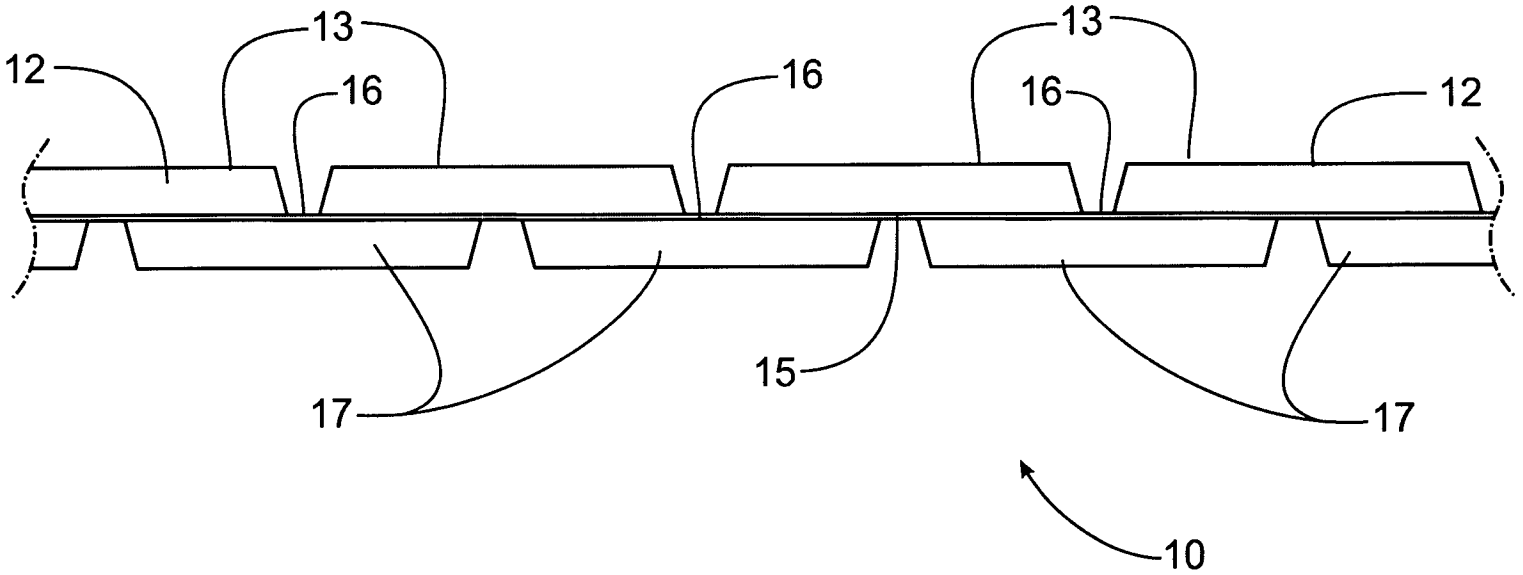
FIG. 3 is a partial end view of the spacer panel depicted in FIG. 2.

Referring to FIGS. 1-3, a spacer panel incorporating the principles of the instant invention can best be seen. The spacer panel 10 is preferably formed from polyvinyl chloride (PVC) film (not shown) having a thickness of about 12 to 16 mil through a conventional vacuum molding process in which the film is placed over a mold (not shown) and heated. A vacuum applied to the film draws the PVC film over a mold to cause the PVC film to assume the shape of the mold. While PVC film is the preferred material from which the spacer panel 10 is formed through the thermal molding, vacuum forming manufacturing process, one of ordinary skill in the art will recognize that other materials may be used in the manufacture of the spacer panel 10, such as thermoplastics and composite materials composed of fibers impregnated with thermoplastic materials. Thermoplastic materials that can be used in the present invention in addition to PVC film are, for example, polystyrenes, acetals, nylons, acrylonitrile-butadiene-styrene (ABS), styrene-acrylonitrile (SAN), polyphenylene oxides, polycarbonates, polyether sulfones, polyaryl sulfones, polyethylene, polystyrene, terephthalates, polyetherketones, polypropylenes, polysilicones, polyphenylene sulfides, polyionomers, polyepoxides, polyvinylidene halides, and derivatives and/or mixtures thereof. The particular material used may depend upon the desired end use and the application conditions associated with that use, as is well known in the art.

The spacer panel 10 is preferably formed in a sheet configuration to conform to conventional building materials typically handled by contractors, such as plywood and OSB sheeting, in order to provide a comfort level to the installers of the spacer panel 10. The first embodiment of the instant invention shown in FIGS. 1-3 is not capable of being rolled; however, the second embodiment shown in FIGS. 4-6 includes flat areas between the spacer members, as will be described in greater detail below, and could be formed in a continuous web that is rolled for shipment and handling at the job site.

The first embodiment of the spacer panel 10 is formed with a set of first spacer members 12 projecting upwardly from a central panel member 15 and a set of second spacer members 17 extending downwardly from the central panel member 15. The reference to upward and downward are used as a matter of convenience and reflect only that the set of first spacer members 12 project out of the central panel member 15 from one face while the set of second spacer members 17 project out of the central panel member 15 from the opposing face of the panel member 10. As can be seen in FIG. 1, the first and second panel members 12, 17 are arranged in a herringbone pattern that orients the spacer members 12, 17 at approximately forty-five degrees to either major axis of the spacer panel 10.

Furthermore, with respect to either major axis of the spacer panel 10, the first and second spacer members 12, 17 overlap, which eliminates any open path of the central panel 15 that would extend along either major axis. As a result, the first embodiment of the spacer panel 10 will not be able to be rolled and, thus, must be formed as a generally flat panel. The first and second spacer members 12, 17 are tapered to be slightly narrower as they project from the central panel 15 and, thus, are shaped to permit nesting so that the spacer panels 10 can be compactly stacked on top of one another for efficient shipping and handling.

Each spacer member 12, 17 is formed independently of each other spacer member 12, 17, so the resistance to compression is not dependent on the integrity of the adjacent spacer element 12, 17. Accordingly, each spacer member 12, 17 is surrounded by a planar portion 16 of the central panel member 15. The planar portions 16 of the central panel member 15 provide a location at which perforations can be positioned to provide a flow communication between the opposing faces of the spacer panel 10. These perforations (not shown) can be formed in a regular pattern throughout the spacer panel 10 or in a random pattern.

The top surface 13 of each spacer member 12, 17 provides a large planar surface on which an adhesive can be applied to the spacer panel 10 in order to mount a barrier member 19, formed of paper or plastic film, that would be operable to keep masonry material out of contact with the spacer panel 10, as can be seen in FIG. 8. The barrier member 19 can be applied on the job site before or after the spacer panel 10 is mounted on the building substructure, or the barrier member 19 can be applied to the spacer panel 10 by the manufacturer, although such application of the barrier member 19 will prevent the spacer panels 10 from nesting and achieving a compact shipping configuration.

Furthermore, the spacer panel 10 is omni-directional in that the spacer panel 10 can be mounted on the building substructure with either major axis of the spacer panel 10 being oriented vertically. The independently formed spacer members 12, 17 with planar portions 16 of the central panel member 15 surrounding each spacer member 12, 17 define a flow path along both faces of the spacer panel 10 to permit moisture to flow downwardly along the central panel member 15. Perforations along the planar portions 16 of the central panel member 15 allow moisture to migrate from one side of the central panel member 15 to the other.

One skilled in the art will recognize that the tapered rectangular spacer members 12, 17 provide a shape and configuration that establishes a resistance to compression from the mounting of the exterior covering materials, as will be described in greater detail below, while establishing a substantial surface on which a barrier member 19 can be mounted. However, other shapes and orientations of spacer members 12, 17 will fall within the scope of the instant invention, including round, oval, triangular or any other geometric shapes. Furthermore, the orientation of the spacer members 12, 17 can be in patterns other than the herringbone pattern as shown in FIGS. 1-3, including a horizontally and vertically linear pattern.

Figure 4:
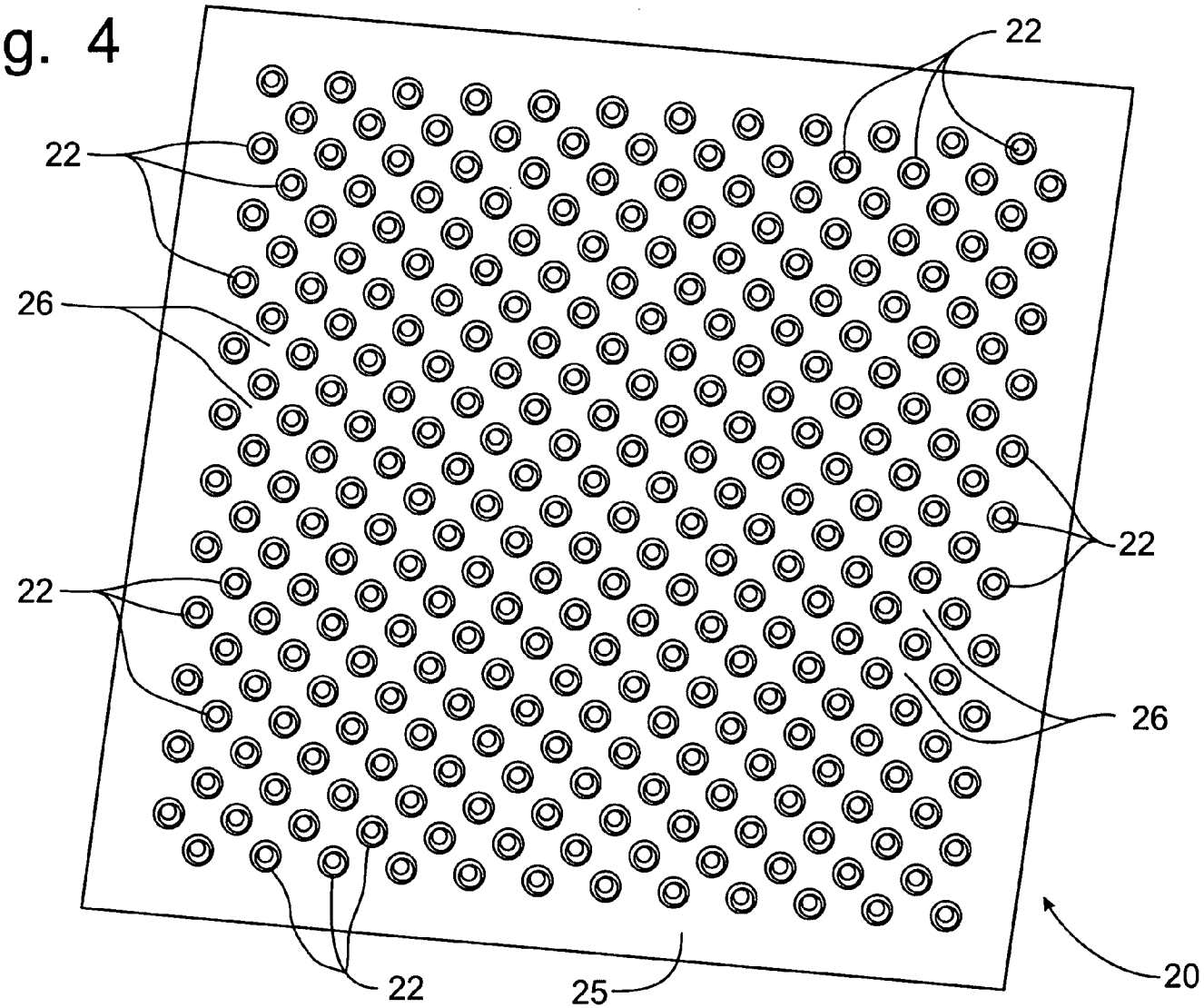
FIG. 4 is a perspective view of a second embodiment of a spacer panel incorporating the principles of the instant invention.
Figure 5:
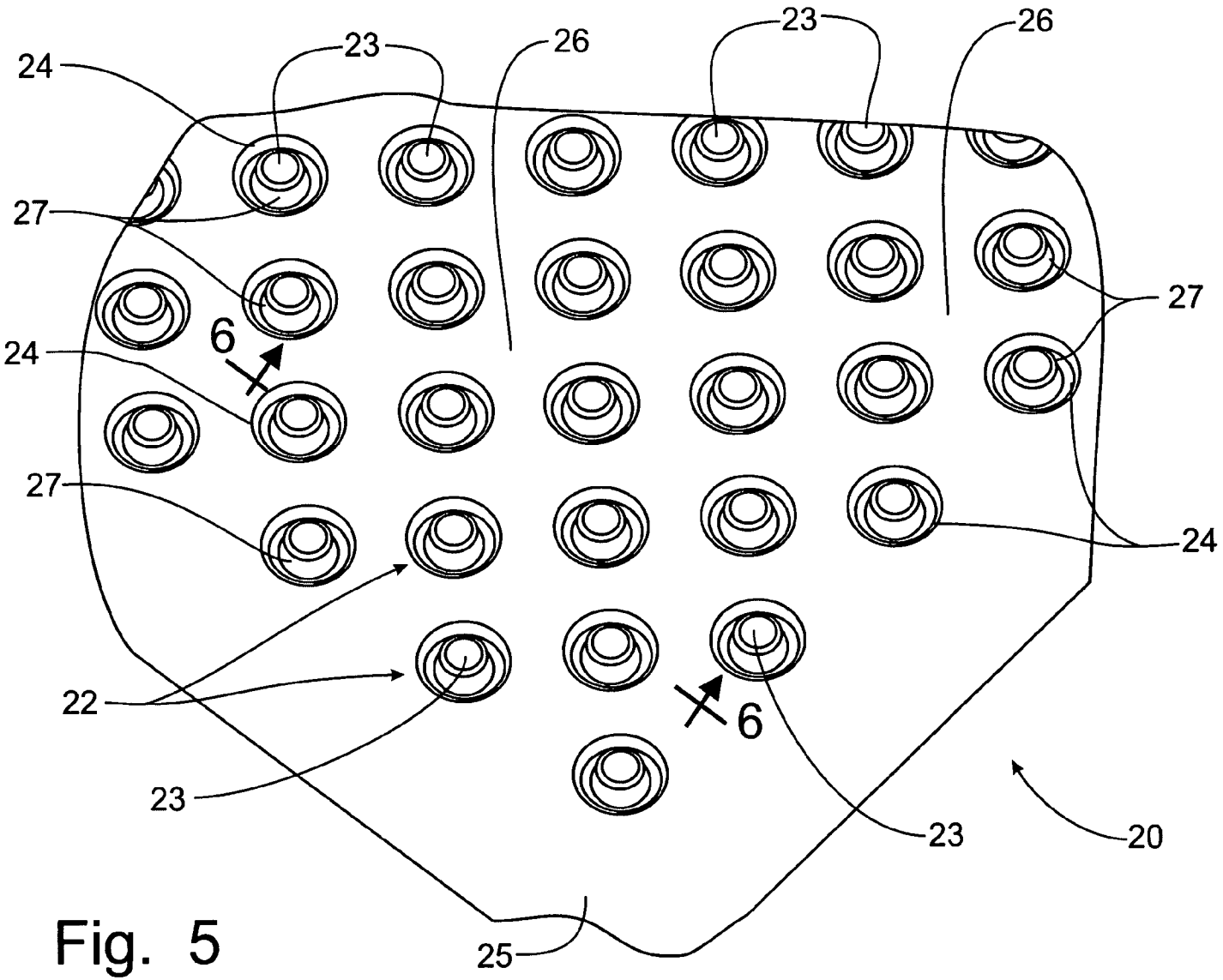
FIG. 5 is an enlarged perspective view of a portion of the spacer panel shown in FIG. 4.
Figure 6:
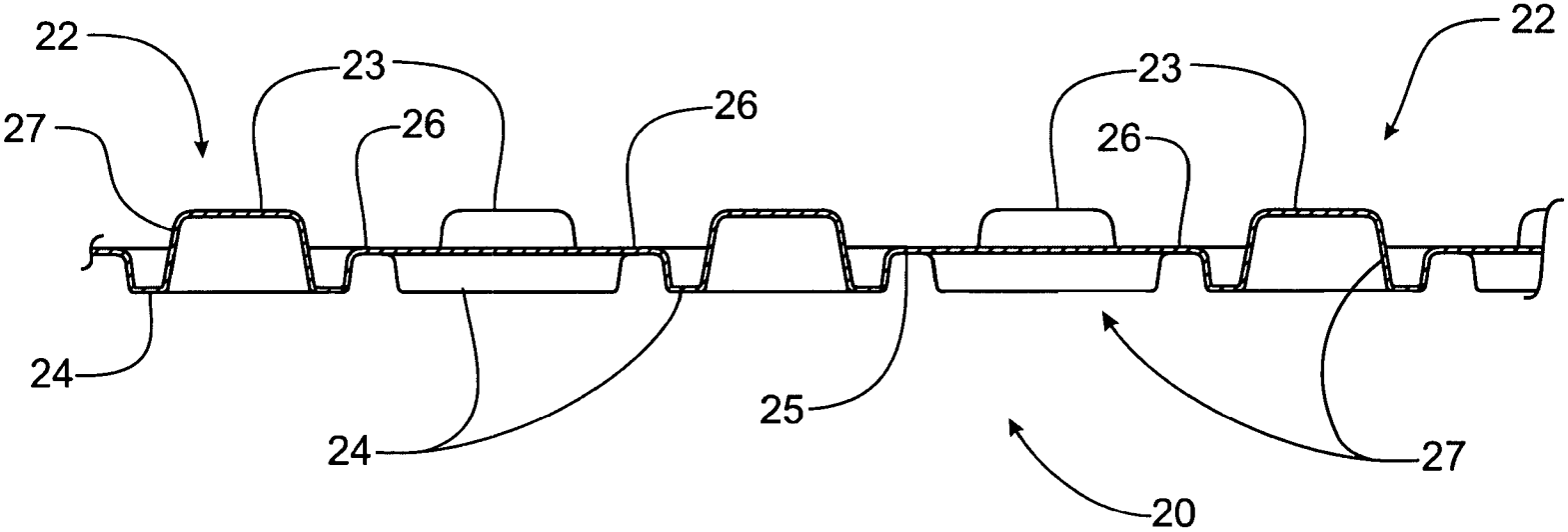
FIG. 6 is a cross-sectional view of the spacer panel taken through the line of spacer members corresponding to lines 6-6 of FIG. 5.

Referring now to FIGS. 4-6, the second embodiment of a spacer panel 20 can best be seen. The spacer members 22 are formed with a component that projects to either side of the central panel member 25, as will be described in greater detail below. The spacer members 22 are generally circular in shape and are arranged in a horizontally and vertically linear pattern with each succeeding row being located in an offset manner with respect to the rows of spacer members 22 in the adjacent rows. As with the first embodiment of the spacer panel 10, each spacer member 22 is independently formed and a planar portion 26 of the central panel member 25 surrounds each spacer member 22. Depending on the ultimate size of the spacer members 22 and the compactness of the rows of spacer members 22, an open path of the central panel member 25 can be established in the direction of either major axis of the panel member 20, which could enable the panel member 20 to be rolled. As will be described below, the spacer members 22 are configured to nest, which would enable the panel member 20 to be either rolled or stacked in a compact arrangement.

Each spacer member 22 is formed, as can best be seen in FIG. 6, with a first circular component 24 the projects downwardly from the central panel member 25 and a second truncated conical member 27 that extends upwardly from the first circular component 24 to project above the central panel member 25. Thus, each spacer member 22 extends on both sides of the central panel member 25. This spacer member 22 configuration presents a shape that is highly resistant to compression. The upwardly extending truncated conical component 27 is tapered, narrowing upwardly, so that the spacer members 22 will nest into one another whether rolled or stacked.

As with the first embodiment of the spacer panel 10, the planar portions 26 of the central panel member 25 provide an appropriate location for the insertion of perforations to permit moisture to migrate from one side of the central panel member 25 to the other. These perforations can be formed in a regular pattern over the spacer panel 20 or irregularly without diminishing the capability of the spacer members to resist compression from the attachment of the exterior surface materials to construct the building wall. Each of the truncated conical components 27 terminates in a planar top surface 23 which provides an adequate surface area for holding adhesive for mounting a barrier member 19, as is depicted in FIG. 7.

The arrangement of the spacer members 22 over the central panel member 25 provides a flow path for moisture on either side of the central panel member 25. Each of the circular first components 24 are also tapered to allow nesting of the spacer members 25; however, this tapered wall of the first circular component 24, which is best seen in FIG. 6, will also provide a downward slope for the drainage of any moisture that might enter into the circular depression formed by the first component 24, irrespective of the direction the spacer panel 20 is mounted on the building substructure.

Looking now at the schematic section of a representative wall construction depicted in FIG. 9, one skilled in the art will note that the spacer panel 10 or 20, the second embodiment being depicted, is placed between the building substructure 30 which is formed of vertical studs 31 supported on a wall plate 32 and having sheathing material 33 fastened with nails or screws, or other fastening devices, to the vertical studs 31 on the outside surface thereof. A protective barrier 34 is wrapped around the sheathing material 33 to stop air and moisture infiltration into the building substructure 30. The spacer panel 20 is then attached to the sheathing material 33 on the outside of the protective barrier 34 by nails, staples or other appropriate fastening devices.

Preferably, for masonry exterior coverings 35, the spacer panel 20 will have a barrier member 19 attached to the top surfaces 23 of the spacer members 22, preferably through the application of adhesives to bond the barrier member 19 to the spacer members 22. The application of masonry material 35, shown schematically as bricks with mortar joints, starts with the attachment of a wire mesh to the barrier member 19 by inserting fasteners (not shown) that extend through the barrier member 19 and the spacer panel 20 into the sheathing material 33. Thus, the resistance to compression for the spacer panel 20 becomes quite critical in the future operation of the spacer panel 20. If the driving of the fasteners to attach the wire mesh collapses the spacer panel 20, the drainage paths created by the spacer members 22 will be destroyed allowing moisture to accumulate behind the masonry material 35.

Since the spacer members 22, and 12, 17 on the first embodiment of the spacer panel 10, are highly resistant to compression, the attachment of the wire mesh does not collapse the spacer panel 20. The masonry exterior in the form of brick or stone with mortar joints, or stucco or related material, cannot pass through the barrier member 19 to clog the drainage paths between the conical components 27 of the spacer members 22. For siding exterior materials (not shown), the wire mesh is not attached to the sheathing material 33, but nails or other fasteners are driven through the siding materials to engage the sheathing material 33, passing through the spacer panel 20. Again, the resistance to compression in the spacer panel 20 is able to prevent the collapse of the drainage paths on either side of the central panel member 25.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A spacer panel for separating an exterior cover material from an interior portion of a building wall structure, comprising:

a generally planar central web member formed of a polymeric material and having first and second opposing sides;

first spacer members formed of said polymeric material and projecting from said first side of said central web member; and second spacer members formed of said polymeric material and projecting from said second side of said central web member, said first and second spacer members being formed with a planar portion of said central web member surrounding each of said first and second spacer members, each of said first and second spacer members defining an offset support surface, respectively, on opposing sides of said central web member, the offset support surfaces on opposing sides of said central web member defining substantially in parallel planes spaced substantially equally from said central web member, said first and second spacer members being formed from said central web member such that the respective opposing offset support surfaces are not directly opposite each other on opposing sides of said central web member, said second spacer members being configured differently structurally from said first spacer members such that said first spacer members provide a different configuration of spacer members on said first side of said central web member compared to said second spacer members on said second side of said central web member;

wherein said first spacer members are circular members projecting from said first side of said central web member; said second spacer members are truncated conical members; and wherein said truncated conical members are formed as an extension of said circular members extending from said circular members through the central web member to position a planar surface outwardly from said second side of said web member.

2. The spacer panel of claim 1 wherein said first and second spacer members define a flow path for water on opposing sides of said central web member with water being able to flow around the respective said spacer members.

3. The spacer panel of claim 2 wherein said first and second spacer members are formed to allow the spacer members formed on one side of said central web member to nest into the spacer members formed on the opposing side of said central web member.

4. The spacer panel of claim 1 wherein said truncated conical members are shaped to nest into the truncated conical members of an adjacent panel member.

5. A spacer panel to separate portions of a building wall structure to allow moisture to escape from between the wall portions, comprising:

a generally planar central portion formed of a polymeric material and having first and second opposing sides;

first and second spacer members formed of said polymeric material and projecting from opposing sides of said central portion to define respective offset support surfaces on opposing sides of said central web member in substantially parallel planes spaced substantially equally from said central web member, said spacer members having a part of said central portion surrounding each of said spacer members, the respective opposing offset support surfaces corresponding to opposing said first and second spacer members being spaced from each other along said central web member, said first and second spacer members providing differently configured flow paths for water on opposing sides of said central portion around the respective said spacer members, said second spacer members being configured differently structurally from said first spacer members such that said first spacer members provide a different configuration of spacer members on said first side of said central web member compared to a corresponding configuration of said second spacer members on said second side of said central web member; and wherein said first spacer members are circular ring members projecting from said first side of said central portion and said second spacer members are truncated conical members.

6. The spacer panel of claim 5 wherein said spacer members are tapered to allow nesting between separate spacer panels.

7. The spacer panel of claim 5 wherein said truncated conical members are formed as an extension of said circular ring members and extend from said circular ring members through the central portion to locate the corresponding said planar support surface outwardly from said second side of said central portion, each said truncated conical member being oriented in opposition to a center of the opposing said circular ring member.

8. A moisture drainage panel for use in constructing a building wall comprising:

a generally planar central portion formed of a polymeric material and having first and second opposing sides;

spacer members formed of said polymeric material and projecting generally perpendicularly from opposing sides of said central portion, said spacer members defining corresponding planar surfaces spaced substantially equidistantly from opposing sides of said central portion and being oriented generally parallel to said central portion, each of said spacer members having a part of said central portion surrounding each said spacer member to define a flow path for water on opposing sides of said central portion, the respective opposing offset support surfaces corresponding to opposing said spacer members being spaced from each other along said central portion, the orientation of said spacer members on one side of said central portion being configured differently structurally than the orientation of the spacer members on the opposing side of said central portion to establish different spacer configurations and differently configured flow paths for water on said opposing sides of said central portion; wherein each said spacer member is formed as a circular member projecting from a first side of said central portion and including a truncated conical member that extends from said circular member through said central portion to position one of said planar surfaces spaced from a second side of said central portion.

9. The moisture drainage panel of claim 8 wherein said spacer members are formed with a planar portion of said central portion extending around each of said spacer members.

* * * * *